US010465880B2

(12) United States Patent
Uhler

(10) Patent No.: US 10,465,880 B2
(45) **Date of Patent: *Nov. 5, 2019**

(54) PLASTIC DOWNLIGHT FIXTURE HAVING INTERLOCKING ATTACHMENT FEATURES

(71) Applicant: TECHNICAL CONSUMER PRODUCTS, INC., Aurora, OH (US)

(72) Inventor: George J. Uhler, Wadsworth, OH (US)

(73) Assignee: TECHNICAL CONSUMER PRODUCTS, INC., Aurora, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,725

(22) Filed: Apr. 24, 2018

(65) Prior Publication Data

US 2018/0238521 A1 Aug. 23, 2018

Related U.S. Application Data

(63) Continuation of application No. 15/054,737, filed on Feb. 26, 2016, now Pat. No. 9,976,723.

(51) Int. Cl.

| | |
|---|---|
| ***F21V 13/04*** | (2006.01) |
| ***F21V 7/22*** | (2018.01) |
| ***F21V 29/70*** | (2015.01) |
| ***F21V 5/04*** | (2006.01) |
| ***F21V 23/00*** | (2015.01) |
| ***F21V 17/00*** | (2006.01) |
| ***F21S 8/02*** | (2006.01) |
| ***F21V 17/10*** | (2006.01) |
| ***F21Y 115/10*** | (2016.01) |

(Continued)

(52) U.S. Cl.

CPC ..... *F21V 13/04* (2013.01); *F21S 8/02* (2013.01); *F21V 5/04* (2013.01); *F21V 7/22* (2013.01); *F21V 17/005* (2013.01); *F21V 17/10* (2013.01); *F21V 23/003* (2013.01); *F21V 29/70* (2015.01); *F21V 7/04* (2013.01); *F21V 21/046* (2013.01); *F21Y 2115/10* (2016.08)

(58) Field of Classification Search

CPC ..... F21V 13/04; F21V 17/164; F21V 23/003; F21V 29/70

See application file for complete search history.

(56) References Cited

U.S. PATENT DOCUMENTS

| | | | |
|---|---|---|---|
| 5,957,565 | A | 9/1999 | Hofmann |
| 7,203,065 | B1 | 4/2007 | Sin Yan Too |

(Continued)

OTHER PUBLICATIONS

RAB Lighting Inc. "ENTRA12N/PC2"; Catalog [online]. May 13, 2015 [retrieved Apr. 13, 2017]. Retrieved from the Internet: <URL: http://www.rabweb.com/product.php?product=ENTRA12N/PC2>; p. 1.

(Continued)

*Primary Examiner* — Anh T Mai
*Assistant Examiner* — Zachary J Snyder
(74) *Attorney, Agent, or Firm* — Thompson Hine LLP

(57) ABSTRACT

A downlight fixture is disclosed, and includes a lens defining at least one lens opening, a reflector, and a housing. The reflector defines at least one first retaining feature and at least one second retaining feature. The at least one lens opening is shaped to receive a corresponding first reflector retaining feature to interlock the lens and the reflector with one another. The housing defines at least one housing opening shaped to receive a corresponding second retaining feature to interlock the housing and the reflector with one another. The lens, the reflector, and the housing are each constructed of plastic.

20 Claims, 6 Drawing Sheets

(51) Int. Cl.
*F21V 7/04* (2006.01)
*F21V 21/04* (2006.01)

(56) References Cited

U.S. PATENT DOCUMENTS

| | | | |
|---|---|---|---|
| 7,914,162 | B1 | 3/2011 | Huang |
| 9,599,315 | B1 | 3/2017 | Harpenau |
| 2003/0156416 | A1 | 8/2003 | Stopa |
| 2011/0075427 | A1 | 3/2011 | Higuchi |
| 2011/0194282 | A1 | 8/2011 | Paik |
| 2012/0081912 | A1 | 4/2012 | Yamamoto |
| 2013/0044485 | A1 | 2/2013 | Zaderej |
| 2013/0286646 | A1 | 10/2013 | Snell |
| 2014/0092601 | A1 | 4/2014 | Orisich et al. |
| 2014/0204562 | A1 | 7/2014 | Mori et al. |
| 2015/0009679 | A1 | 1/2015 | Seki |

OTHER PUBLICATIONS

PCT, International Search Report and Written Opinion of the International Searching Authority, International Application No. PCT/US2017/018558, 8 pages, dated May 8, 2017.
U.S. Appl. No. 15/054,737, Non-Final Office Action, 30 pages, dated Jul. 24, 2017.
U.S. Appl. No. 15/054,737, Notice of Allowance, 9 pages, dated Jan. 25, 2018.

PLASTIC DOWNLIGHT FIXTURE HAVING INTERLOCKING ATTACHMENT FEATURES

TECHNICAL FIELD

The present disclosure relates generally to a downlight fixture, and more particularly to a downlight fixture having a lens, a reflector, and a housing that are each constructed of plastic and are interlocked with one another.

BACKGROUND

Light emitting diode (LED) based lighting systems may offer several energy and reliability advantages over other types of lighting systems such as, for example, incandescent or fluorescent lighting. Thus, LED based lighting systems are increasingly being used to replace other existing lighting technologies. Moreover, it should also be appreciated that downlight fixtures are also increasing in popularity due to their aesthetic appeal, light output, and versatility.

While downlight fixtures offer many advantages, there are also some drawbacks as well. For example, the processes used for manufacturing a downlight may be time consuming, costly, and may even require relatively skilled personnel and tooling in some instances. Furthermore, the downlight fixtures currently available usually include a housing that is constructed of metal. The housing may need to be painted a specific color such as, for example, white or beige, in order to meet consumer preferences. However, painting the housing requires an additional step during manufacture, which adds cost and complexity to the downlight fixture. Finally, downlight fixtures typically include numerous fasteners that are used to join the various components together. These fasteners also add to the overall cost and complexity of a downlight fixture. Thus, there exists a continuing need in the art for a cost effective downlight fixture that is simple to assemble.

SUMMARY

In one embodiment, a downlight fixture is disclosed, and includes a lens defining at least one lens opening, a reflector, and a housing. The reflector defines at least one first retaining feature and at least one second retaining feature. The at least one lens opening is shaped to receive a corresponding first reflector retaining feature to interlock the lens and the reflector with one another. The housing defines at least one housing opening shaped to receive a corresponding second retaining feature to interlock the housing and the reflector with one another. The lens, the reflector, and the housing are each constructed of plastic.

In another embodiment, a light emitting diode (LED) downlight fixture is disclosed and includes a lens defining at least one lens opening, a reflector, a housing, and an LED engine positioned within the housing. The reflector defines at least one first retaining feature and at least one second retaining feature. The at least one lens opening is shaped to receive a corresponding first reflector retaining feature to interlock the lens and the reflector with one another. The housing defines at least one housing opening shaped to receive a corresponding second retaining feature to interlock the housing and the reflector with one another. The lens, the reflector, and the housing are each constructed of plastic.

In another embodiment, a method of assembling a downlight fixture is disclosed. The method includes receiving a first retaining feature of a reflector by a lens opening defined by a lens, where the lens opening is shaped to receive the first retaining feature of the reflector to interlock the lens and the reflector with one another. The method also includes receiving a second retaining feature of the reflector by a housing opening defined by a housing, where the housing opening is shaped to receive the second retaining feature to interlock the housing and the reflector with one another.

DETAILED DESCRIPTION

Figure 1:
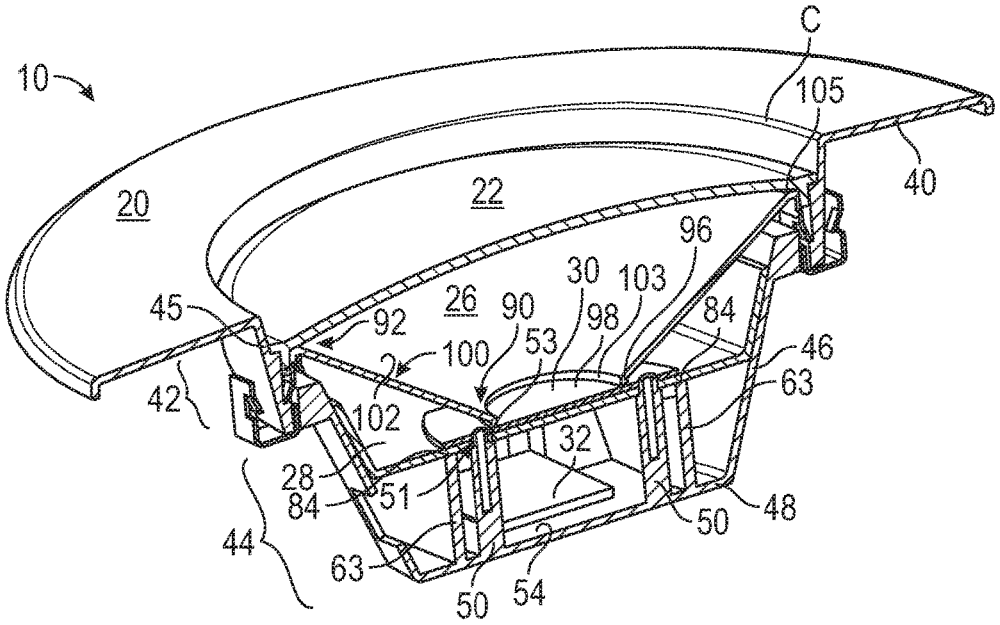
FIG. 1 is a perspective, cross-sectioned view of the disclosed downlight fixture including a housing, a lens, a reflector, a heat sink, a light emitting diode (LED) engine, and a driver board.

The following detailed description will illustrate the general principles of the invention, examples of which are additionally illustrated in the accompanying drawings. In the drawings, like reference numbers indicate identical or functionally similar elements.

FIG. 1 is a perspective, cross-sectioned view of an exemplary downlight fixture 10. The downlight fixture 10 may include a housing 20, a lens 22, a reflector 26, a heat sink 28, a light emitting diode (LED) engine 30, and a driver board 32. As explained in greater detail below, the housing 20, the lens 22, and the reflector 26 may each be constructed of plastic. Although the downlight fixture 10 shown in FIG. 1 includes an LED light engine 30, it is to be understood that the disclosure is not limited to LED lighting. Indeed, the disclosure may be applied to other types of lighting as well such as, but not limited to, field-induced polymer electroluminescent (FIPEL) lighting and organic LED (OLED) lighting.

The housing 20 contains the lens 22, the reflector 26, the heat sink 28, the LED engine 30, and the driver board 32. The housing 20 may be constructed of a plastic such as, for example, polycarbonate. The housing 20 may define a rim 40 that extends around a circumference C of the housing 20. It is to be appreciated that the rim 40 may be visible once the downlight fixture 10 is installed. The housing 20 also includes a first tapered portion 42 and a second tapered portion 44. The first tapered portion 42 of the housing 20 may be defined by a generally annular wall 45 that tapers inwardly towards a bottom wall 48 of the housing 20. The second tapered portion 44 of the housing 20 may also be defined by a generally annular wall 46 that tapers inwardly towards the bottom wall 48 of the housing 20.

Figure 2:
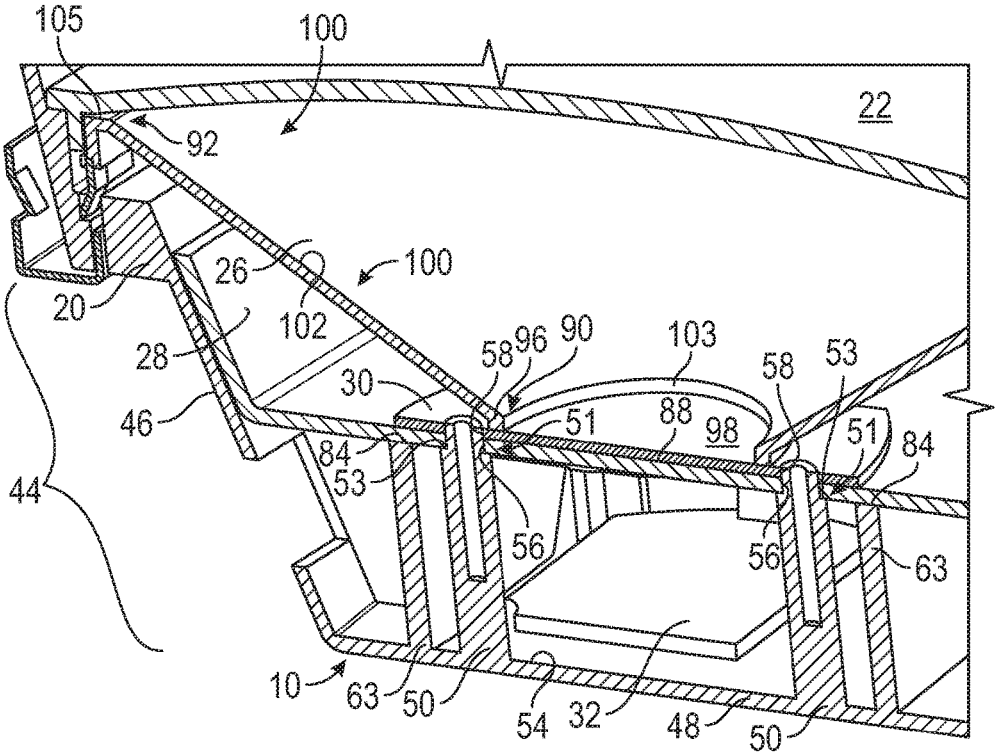
FIG. 2 is another view of the downlight fixture shown in FIG. 1.

As seen in both FIGS. 1 and 2, a plurality of locating pins 50 may project outwardly from an inner surface 54 of the bottom wall 48 of the housing 20. The locating pins 50 may each include a stepped portion 51 that defines a surface 53. Although FIGS. 1 and 2 illustrate two locating pins 50, it is to be understood that this illustration is merely exemplary in nature and any number of locating pins may be used as well. The locating pins 50 may be used to locate and provide support to both the heat sink 28 and the LED engine 30. Referring to FIG. 2, the heat sink 28 and the LED engine 30 both define respective apertures 56, 58 that are shaped to receive the locating pins 50. The locating pins 50 may eliminate the need for fasteners to locate and support the heat sink 28 and the LED engine 30.

Figure 3:
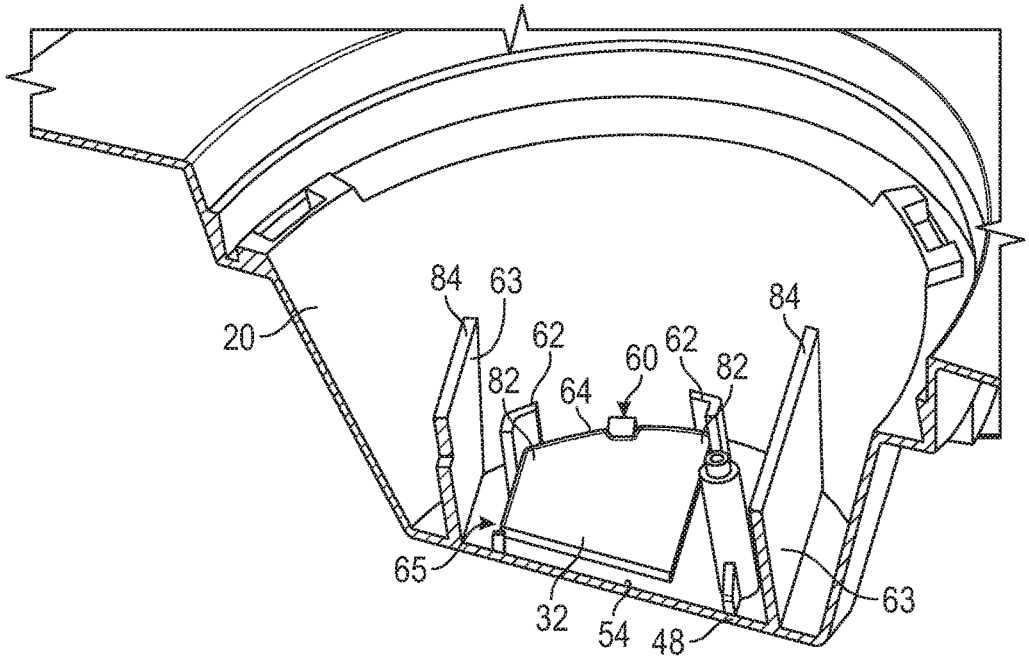
FIG. 3 is a cross-sectioned elevational view of the housing and the driver board shown in FIG. 1.
Figure 4A:
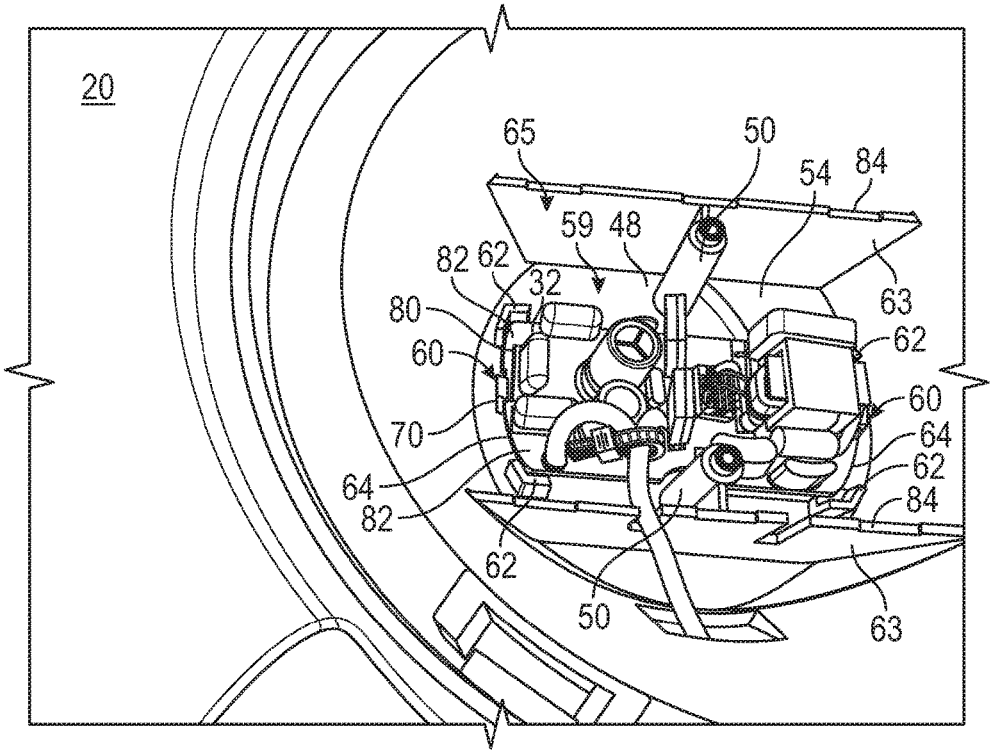
FIG. 4A is another elevational view of the housing and the driver board.

FIG. 3 is an elevated cross-sectioned view of the housing 20 where the lens 22, the reflector 26, the heat sink 28, and the LED engine 30 have all been omitted in order to show the bottom wall 48 of the housing 20 and the driver board 32. FIG. 4A is another view of the housing 20 and the driver board 32. As seen in FIG. 4A, the driver board 32 may include various power electronics 59 required for electrical operation of the LED engine 30 and the downlight fixture 10.

Figure 4B:
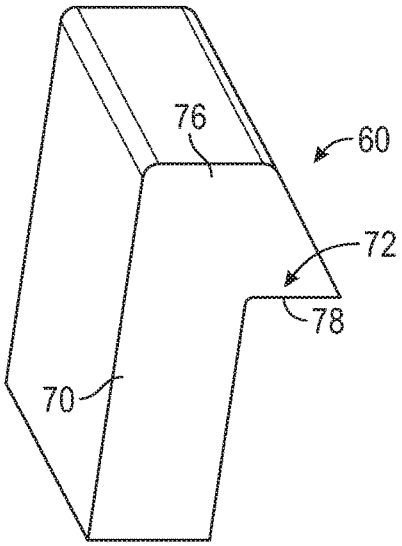
FIG. 4B is an enlarged view of a retaining feature shown in FIG. 4A.

Referring to FIGS. 3 and 4A, a plurality of retaining features 60, a plurality of locating features 62, and a pair of opposing walls 63 may be located along the inner surface 54 of the bottom wall 48 of the housing 20. The walls 63 define a cavity 65, where the driver board 32 is placed within the cavity 65. In one embodiment, two retaining features 60 may be located on opposing sides 64 of the driver board 32, however it is to be appreciated that any number of retaining features 60 may be used. As seen in FIGS. 4A and 4B, each retaining feature 60 is a flexible finger 70 that projects outwardly from the inner surface 54 of the bottom wall 48 of the housing 20. A ledge 72 may be located along a free end 76 of each finger 70 (seen in FIG. 4B). The ledge 72 of each finger 70 defines a surface 78. During assembly of the downlight fixture 10 as the driver board 32 is secured to the housing 20, the finger 70 of the housing 20 may bend or flex over the driver board 32. The surface 78 of the finger 70 may then abut against an upper surface 80 of the driver board 32. The abutment between the finger 70 and the driver board 32 creates a snap-fit interlock that secures the driver board 32 in place within the housing 20. Referring to FIGS. 3, 4A and 4B, the locating features 62 may be shaped to correspond with the respective corners 82 of the driver board 32. In one embodiment, four locating features 62 are provided for each corner 82 of the driver board 32.

Turning back to FIGS. 1-2 and 4A, the heat sink 28 may be seated against an upper surface 84 of the opposing walls 63 and the surface 53 defined by the locating pins 50. The driver board 32, the reflector 26, and the LED light engine 30 may each be contained within the second tapered portion 44 of the housing 20. The heat sink 28 may be constructed of metal, or alternatively a thermally conductive plastic. One commercially available example of a thermally conductive plastic is sold under the trade name THERMA-TECH, and is available from the PolyOne Corporation of Avon Lake, Ohio. Referring to FIG. 2, during assembly of the downlight fixture 10 a thermal grease (not illustrated) may be applied along a lower surface 88 of the heat sink 28. The LED light engine 30 may then be placed over the thermal grease located along the lower surface 88 of the heat sink 28. Those of ordinary skill in the art will appreciate that the thermal grease may act as a thermal conductor, and is commonly used as an interface between heat sinks and heat sources (i.e., the LED light engine 30).

The reflector 26 may be constructed of plastic such as, for example, polycarbonate. The reflector 26 may include a first end portion 90, a second end portion 92 and a frustoconical portion 100. A lip 96 may be located at the first end portion 90 of the reflector 26, and is seated against an upper surface 98 of the LED light engine 30. A reflective coating such as, for example, a metallized coating, may be disposed along an inner surface 102 of the frustoconical portion 100 of the reflector 26. Those of ordinary skill in the art will readily appreciate that the reflective layer may be used to spread and direct light generated by the LED light engine 30. The frustoconical portion 100 of the reflector 26 is disposed between the first end portion 90 and the second end portion 92 of the reflector 26. The first end portion 90 of the reflector 26 may define a first opening 103 and the second end portion 92 of the reflector 26 may define a second opening 105, where the second opening 105 includes a diameter that is larger than a diameter of the first opening 103.

Figure 5:
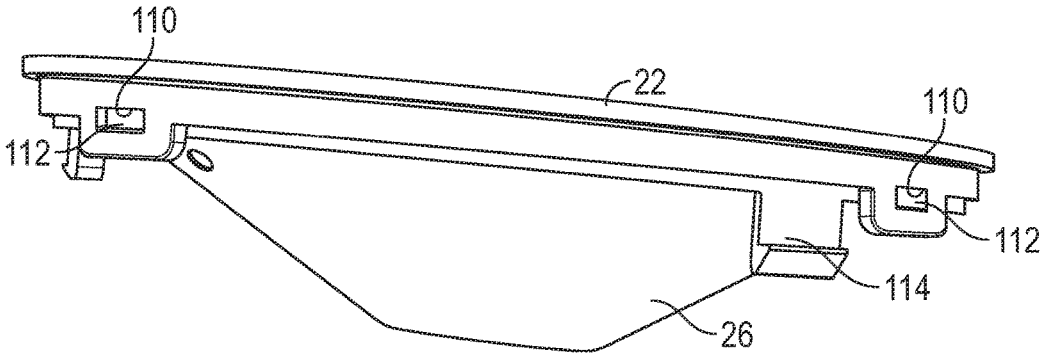
FIG. 5 is an illustration of the lens and the reflector interlocked with one another.

FIG. 5 is an illustration of the reflector 26 assembled to the lens 22. As explained in greater detail below, the lens 22 may include one or more openings or windows 110. The windows 110 may be circumferentially disposed around the lens 22. The windows 110 of the lens 22 may be shaped to each receive a corresponding retaining feature or finger 112 of the reflector 26, which creates a snap-fit interlock that secures the lens 22 and the reflector 26 together. The reflector 26 may also include at least one retaining feature or finger 114, where the fingers 114 may be circumferentially disposed around the reflector 26. As explained in greater detail below, corresponding openings or windows 118 (FIG. 6) circumferentially disposed around the housing 20 may be shaped to each receive a corresponding finger 114 of the reflector 26 and create a snap-fit interlock that secures the reflector 26 and the housing 20 together (seen in FIG. 7). Thus, it is to be appreciated that the reflector 26 defines retaining features that interlock with both the housing 20 as well as the lens 22, which may eliminate the need for any fasteners or other types of devices to secure the housing 20, the lens 22, and the reflector 26 together.

Figure 6:
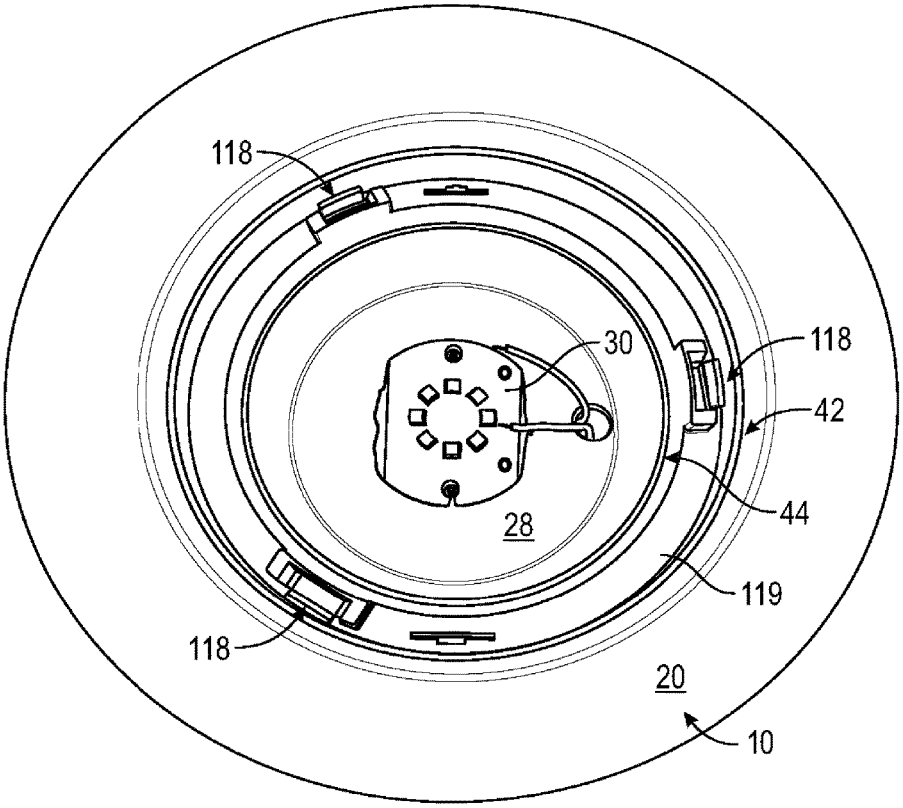
FIG. 6 is a top view of the housing, the heat sink, and the LED light engine.
Figure 7:
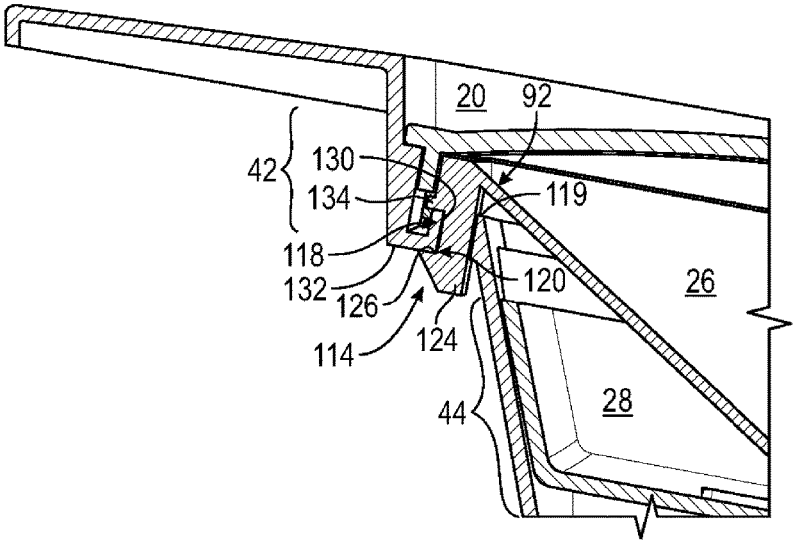
FIG. 7 is a cross-sectioned view of the housing and the reflector interlocked with one another.

FIG. 6 is a top view of the housing 20, the heat sink 28, and the LED light engine 30. In the non-limiting embodiment as shown, the housing includes three openings or windows 118 spaced equidistant from one another, however it is to be appreciated that any number of windows 118 and spacing configurations may be used as well. FIG. 7 is a cross-sectioned view of one of the windows 118 of the housing 20 and one of the fingers 114 of the reflector 26 interlocked with one another. As seen in FIGS. 6-7, the windows 118 of the reflector 26 may each be located along a shelf 119 located between the first tapered portion 42 and the second tapered portion 44 of the housing 20.

As seen in FIG. 7, each window 118 of the housing 20 may be shaped to receive one of the fingers 114 of the reflector 26. The finger 114 may be located at the second end portion 92 of the reflector 26. A free end 124 of the finger 114 may define a ledge 120. The ledge 120 defines a surface 126. During assembly of the downlight fixture 10 as the reflector 26 is secured with the housing 20, the finger 114 may bend or flex within an aperture 130 defined by the window 118. The surface 126 of the finger 114 may then abut against a lower surface 132 of the housing 20. The lower surface 132 may be defined between the first tapered portion 42 and the second tapered portion 44 of the housing 20. The abutment between the finger 114 and the surface 132 of the housing 20 creates a snap-fit interlock that secures the reflector 26 and the housing 20 together. The finger 114 may also define a protrusion 134 that projects outwardly from the finger 114. The protrusion 134 may abut against the shelf 119 of the housing 20.

Figure 8:
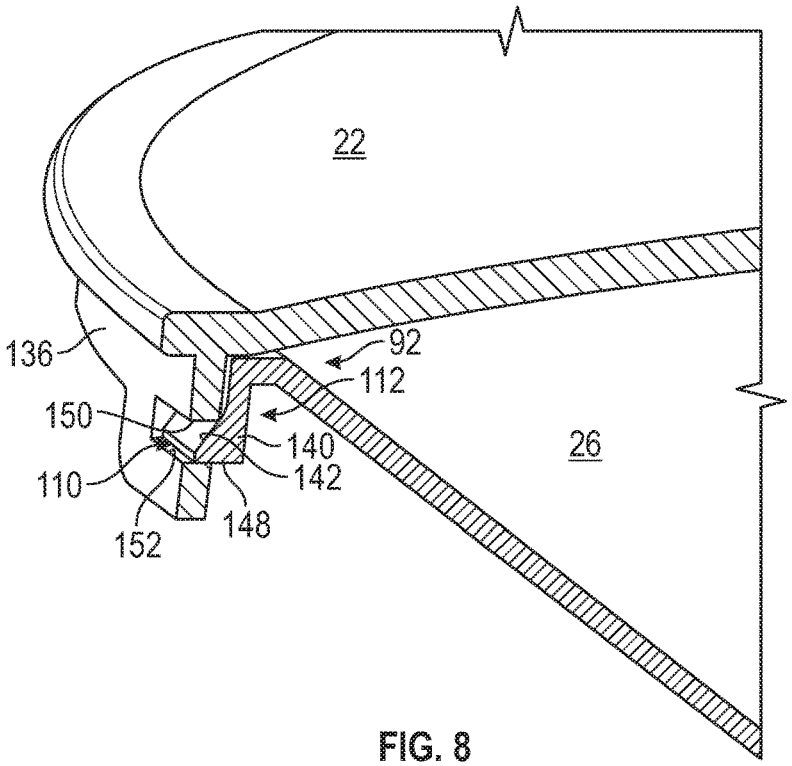
FIG. 8 is a cross-sectioned view of the lens and the reflector interlocked with one another.

FIG. 8 is a cross-sectioned view of one of the windows 110 of the lens 22 and one of the fingers 112 of the reflector 26 interlocked with one another. The window 110 may be defined by a side wall 136 that extends circumferentially around the lens 22. The finger 112 may be located at the second end portion 92 of the reflector 26. The finger 112 of the reflector 26 may define a free end 140. The finger 112 may define a flared or ramped portion 142 located at the free end 140 of the reflector 26. The ramped portion 142 of the finger 112 may gradually increase in wall thickness and terminate at a flat end 148. During assembly of the downlight fixture 10 as the lens 22 and the reflector 26 are secured to one another, the finger 112 may bend or flex within an aperture 150 defined by the window 110. The flat end 148 of the finger 112 may then abut against a lower surface 152 defined by the opening 150 of the lens 22, and the ramped portion 142 of the finger 112 is contained within the opening 150 of the lens 22 to create a snap-fit interlock that secures the reflector 26 and the lens 22 together. It is to be appreciated that the snap-fit interlock between the reflector 26 and the lens 22, as well as the snap-fit interlock between the housing 20 and the reflector 26 (shown in FIG. 7) may also eliminate the need for fasteners to secure the heat sink 28 and the LED light engine 30 in place within the housing 20.

Figure 9:
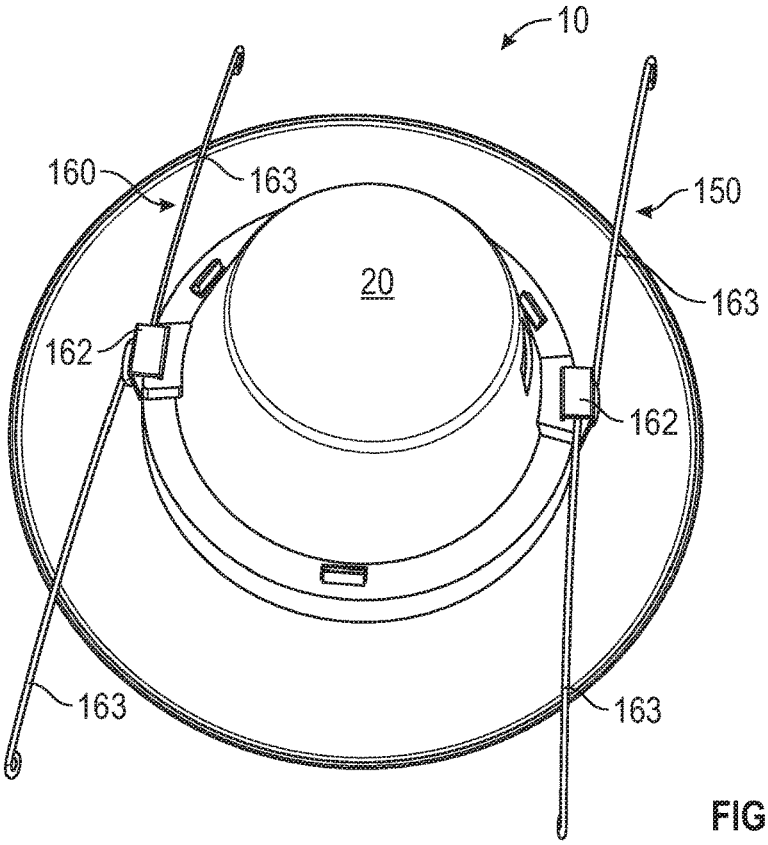
FIG. 9 illustrates a bottom portion of the downlight assembly, where two biasing elements and two clips are assembled to the housing.
Figure 10:
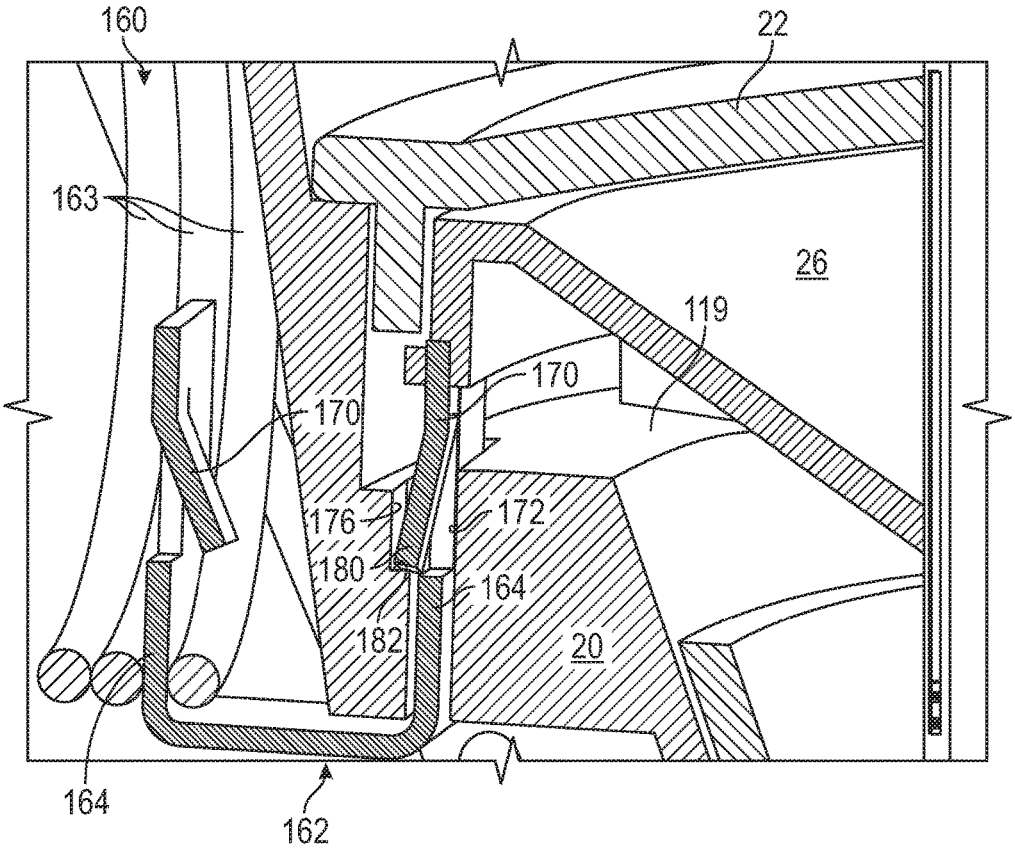
FIG. 10 is an enlarged, cross-sectioned view of the housing, the lens, one of the biasing elements, and one of the clips shown in FIG. 9.

FIG. 9 illustrates the bottom portion of the downlight assembly 10, where two biasing elements 160 and two clips 162 are assembled to the housing 20. The biasing elements 160 and the clips 162 may be disposed about one hundred and eighty degrees apart from one another on the housing 20. The biasing elements 160 may be used to install the downlight fixture 10 within a building or other structure. FIG. 10 is an enlarged, cross-sectioned view of the housing 20, the lens 22, the reflector 26, one of the biasing elements 160, and one of the clips 162. The clips 162 may be constructed of metal. The biasing elements 160 may define a plurality of coils 163 as well as straight portions 165 (shown in FIG. 9).

As seen in FIG. 10, in one embodiment the clip 162 may include a generally U-shaped profile, which defines two generally opposing arms 164. Each arm 164 of the clip 162 includes a flexible member 170 that extends inwardly towards the remaining arm 164 of the clip 162. One of the arms 164 of the clip 162 may be received by an opening 172 defined by the housing 20. The opening 172 may be located along the shelf 119 of the housing 20 The member 170 of the arm 164 may be biased towards an outer wall 176 of the opening 172. An end portion 180 of the member 170 may abut against the outer wall 176 of the opening 172, and is seated against a bottom surface 182 of the opening.

Referring generally to the figures, the disclosed downlight assembly includes a lens, reflector, and housing that are interlocked with one another, which in turn may eliminate the need for mechanical fasteners. Furthermore, unlike the housings currently available that are constructed of metal, the disclosed housing may be constructed of a colored plastic such that the housing is molded as a specific color. Thus, the disclosed housing may not require painting, which adds cost and complexity during manufacture. The disclosed downlight assembly may also result in reduced labor time and costs. Furthermore, because the disclosed downlight assembly is relatively easy and simple to assemble, the personnel used to assemble the downlight may not need to be as skilled as some of the individuals who currently assemble downlights. Finally, since the disclosed downlight assembly may be substantially constructed of plastic components, this may eliminate the need to include extra capacitors or a mode choke to suppress electromagnetic interference (EMI).

While the forms of apparatus and methods herein described constitute preferred embodiments of this invention, it is to be understood that the invention is not limited to these precise forms of apparatus and methods, and the changes may be made therein without departing from the scope of the invention.

What is claimed is:

1. A downlight fixture, comprising:

a lens defining at least one lens opening;

a reflector defining at least one first retaining feature and at least one second retaining feature, wherein the at least one lens opening is shaped to receive a corresponding one of the first retaining feature to interlock the lens and the reflector with one another; and a housing defining at least one housing opening shaped to receive a corresponding one of the second retaining feature to interlock the housing and the reflector with one another, wherein the at least one lens opening is interlocked with the corresponding one of the first retaining feature and the at least one housing opening is interlocked with the corresponding one of the second retaining feature to secure the lens and the reflector within the housing, and wherein the lens, the reflector, and the housing are each constructed of plastic.

2. The downlight fixture of claim 1, wherein the at least one first retaining feature of the reflector is a finger that includes a ramped portion, and wherein the ramped portion of the finger engages within the at least one lens opening.

3. The downlight fixture of claim 1, wherein the at least one second retaining feature of the reflector is a finger that includes a protrusion that projects outwardly from the finger, and wherein the projection abuts against an shelf disposed on an exterior of the housing.

4. The downlight fixture of claim 1, wherein the housing defines a bottom wall defining an inner surface, and wherein at least one locator pin projects outwardly from the inner surface of the bottom wall.

5. The downlight fixture of claim 4, comprising a heat sink positioned within the housing, wherein the heat sink defines at least one first aperture shaped to receive a corresponding one of the at least one locator pin.

6. The downlight fixture of claim 5, comprising a light emitting diode (LED) engine positioned within the housing, wherein the LED engine defines at least one second aperture shaped to receive the corresponding one of the at least one locator pin.

7. The downlight fixture of claim 6, wherein the reflector defines a first end portion, a second end portion, and a frustoconical portion disposed between the first end portion and the second end portion, wherein a lip is located at the first end portion of the reflector and is seated against the LED engine.

8. The downlight fixture of claim 4, comprising a driver board contained within the housing and including electronics for electrical operation of the downlight.

9. The downlight fixture of claim 8, wherein at least one board retaining feature projects outwardly from the inner surface of the bottom wall of the housing and abuts against the driver board to secure the driver board in place within the housing.

10. The downlight fixture of claim 1, wherein the lens, the reflector, and the housing are constructed of polycarbonate.

11. A light emitting diode (LED) downlight fixture, comprising:

a LED light engine;

a lens defining at least one lens opening;

a reflector defining at least one first retaining feature and at least one second retaining feature, wherein the at least one lens opening is shaped to receive a corresponding one of the first retaining feature to interlock the lens and the reflector with one another; and a housing defining at least one housing opening shaped to receive a corresponding one of the second retaining feature to interlock the housing and the reflector with one another, wherein the at least one lens opening is interlocked with the corresponding one of the first retaining feature and the at least one housing opening is interlocked with the corresponding one of the at least one second retaining feature to secure the lens and the reflector within the housing, and wherein the lens, the reflector, and the housing are each constructed of plastic.

12. The LED downlight fixture of claim 11, wherein the at least one first retaining feature of the reflector is a finger that includes a ramped portion, and wherein the ramped portion of the finger engages within the at least one lens opening.

13. The LED downlight fixture of claim 11, wherein the at least one second retaining feature of the reflector is a finger that includes a protrusion that projects outwardly from the finger, and wherein the projection abuts against an shelf disposed on an exterior of the housing.

14. The LED downlight fixture of claim 11, wherein the housing defines a bottom wall defining an inner surface, and wherein at least one locator pin projects outwardly from the inner surface of the bottom wall.

15. The LED downlight fixture of claim 14, comprising a heat sink positioned within the housing, wherein the heat sink defines at least one first aperture shaped to receive a corresponding one of the at least one locator pin.

16. The LED downlight fixture of claim 15, wherein the LED engine defines at least one second aperture shaped to receive the corresponding one of the at least one locator pin.

17. The LED downlight fixture of claim 16, wherein the reflector defines a first end portion, a second end portion, and a frustoconical portion disposed between the first end portion and the second end portion, wherein a lip is located at the first end portion of the reflector and is seated against the LED engine.

18. The LED downlight fixture of claim 14, comprising a driver board contained within the housing and including electronics for electrical operation of the downlight.

19. A method of assembling a downlight fixture, comprising:

receiving a first retaining feature of a reflector by a lens opening defined by a lens, wherein the lens opening is shaped to receive the first retaining feature of the reflector to interlock the lens and the reflector with one another;

receiving a second retaining feature of the reflector by a housing opening defined by a housing, wherein the housing opening is shaped to receive the second retaining feature to interlock the housing and the reflector with one another, whereupon the lens opening is interlocked with first retaining feature and the housing opening is interlocked with the second retaining feature to secure the lens and the reflector within the housing.

20. The method of claim 19, comprising constructing each of the lens, the reflector, and the housing of plastic.

* * * * *